US008550277B2

(12) United States Patent
Grönholm

(10) Patent No.: US 8,550,277 B2
(45) Date of Patent: Oct. 8, 2013

(54) CAGE FOR HANDLING OR STORING GOODS

(75) Inventor: Jack Grönholm, Söderkulla (FI)

(73) Assignee: K. Hartwell Oy AB, Soderkulla (FI)

( * ) Notice: Subject to any disclaimer, the term of this patent is extended or adjusted under 35 U.S.C. 154(b) by 0 days.

(21) Appl. No.: 13/391,043

(22) PCT Filed: Aug. 19, 2010

(86) PCT No.: PCT/FI2010/050657

§ 371 (c)(1),
(2), (4) Date: Mar. 6, 2012

(87) PCT Pub. No.: WO2011/020951

PCT Pub. Date: Feb. 24, 2011

(65) Prior Publication Data

US 2012/0152946 A1 Jun. 21, 2012

(30) Foreign Application Priority Data

Aug. 19, 2009 (FI) ..... 20095854

(51) Int. Cl.
*B65D 6/16* (2006.01)
*B65D 6/00* (2006.01)

(52) U.S. Cl.
USPC ..... 220/6; 220/4.01; 312/322

(58) Field of Classification Search
USPC ..... 206/600, 386, 577; 220/6, 1.5, 7, 220/4.28–4.34, 485, 489; 119/482; 312/222
See application file for complete search history.

(56) References Cited

U.S. PATENT DOCUMENTS

| | | | | |
|---|---|---|---|---|
| 2,968,418 | A | 1/1961 | Stoddard | |
| D296,600 | S | 7/1988 | Singerman et al. | |
| 4,763,606 | A | 8/1988 | Ondrasik, II | |
| 4,830,200 | A | 5/1989 | Zambano et al. | |
| 4,852,212 | A * | 8/1989 | Amann | 312/322 |
| D338,749 | S | 8/1993 | McConnell | |
| 5,660,291 | A | 8/1997 | Dash | |
| D427,730 | S | 7/2000 | Powers et al. | |
| D453,027 | S | 1/2002 | Andujar | |
| D473,378 | S | 4/2003 | Bellersheim | |
| D494,016 | S | 8/2004 | Compagnucci | |

(Continued)

FOREIGN PATENT DOCUMENTS

| | | | |
|---|---|---|---|
| DE | 1 966 063 | A1 | 10/1971 |
| EP | 0 052 529 | A1 | 5/1982 |
| GB | 1 335 994 | A | 10/1973 |
| JP | 2002-205739 | A | 7/2002 |

*Primary Examiner* — Andrew Perreault

(74) *Attorney, Agent, or Firm* — Birch, Stewart, Kolasch & Birch, LLP

(57) ABSTRACT

A collecting cage has a front end to which at least one door is pivoted with the aid of a pivoting device. The cage also has at least three lateral walls. The pivoting device is adapted to pivot the door to an opened position and to a closed position thus covering at least part of it. The pivoting device is adapted to guide the door in an opened position to a direction parallel to a lateral wall and at a clearance therefrom for flanking the cage. The pivoting device includes at least two angle members connected to the door at a distance from each other and having a first portion protruding from the door and having a second portion in an angled position relative to the first portion, and at least two corresponding rails connected to a lateral wall.

5 Claims, 16 Drawing Sheets

(56) References Cited

U.S. PATENT DOCUMENTS

| | | | |
|---|---|---|---|
| 6,832,580 | B2 | 12/2004 | Marchioro |
| D508,167 | S | 8/2005 | Anderson et al. |
| D512,223 | S | 12/2005 | Snell |
| D586,558 | S | 2/2009 | Ziemann et al. |
| D621,100 | S | 8/2010 | Simpson et al. |
| 2007/0159037 | A1 | 7/2007 | Hoffman |

* cited by examiner

CAGE FOR HANDLING OR STORING GOODS

BACKGROUND OF THE INVENTION

1. Field of the Invention

The present invention relates to cargo handling equipment. In particular, the invention relates to cages used for bundling up items during transport and for temporary storage. To be precise, the invention relates to a collecting cage according to the preamble part of claim 1.

2. Description of the Related Art

Parcelled goods have been traditionally transported by stacking the goods on pallets, wrapping the unit with shrink wrap and loading the wrapped pallets onto trailers or lorries. The traditional way of handling parcelled freight has been deemed uneconomical due to the labour intensity of packing pallets, extensive use of packing material, such as shrink wrap and cardboard. Traditional pallets have also provided little protection against brisk handling, which has resulted in damages and increased the cost of transport. To tackle these problems, collecting cages have been introduced.

Collecting cages are typically stackable and foldable cages made of high tensile steel that provides an attractive alternative to distribution and storage of high volume goods. The collecting cages, cages in short, are usually handled with a fork lift similarly to traditional pallets. Because the cages are stackable, they can be stacked on top each other, which enables high volumetric efficiency when transporting full cages. On the other hand, because the cages are foldable, high volumetric efficiency is also achieved when transporting empty cages. Furthermore, the robust structure of the cage protects the cargo during handling.

However, known cages have considerable disadvantages. Because the cages are designed to withstand burly handling, known structures feature elements, such as hinges, whose primary purpose is to endure great forces. In real life, such robust cages have been found cumbersome to use. While providing improvement to the economy of transport, known cages tend to require abundantly effort or space to maneuver.

It is an object of the present invention to solve at least some of the aforementioned disadvantages and to provide an improved collecting cage.

SUMMARY OF THE INVENTION

The invention is based on a novel collecting cage, which has a prismatic crate-like shape, for handling or storing goods, particularly parcelled goods. The cage has a front end to which at least one door is pivoted with the aid of pivoting means. The cage also has at least three lateral walls that are perpendicular to the front end. The pivoting means are adapted to pivot the door to an opened position non-parallel to the front end and to a closed position parallel to the front end thus covering at least part of it. The pivoting means are also adapted to guide the door in an opened position to a direction parallel to a lateral wall and at a clearance there from for flanking the cage. The pivoting means comprise at least two angle members connected to the door at a distance from each other and having a first portion protruding from the door and having a second portion in an angled position—preferably perpendicularly—relative to the first portion. The pivoting means also comprise at least two corresponding rails connected to a lateral wall, wherein the angle members are adapted movably to a rail from the second portions for moving the door in relation to the lateral wall.

More specifically the present invention is characterized by what is stated in the characterizing portion of claim 1.

Considerable advantages are gained with the aid of the present invention. Because the doors can be folded away, a cage according to the invention is efficient both in terms of labour and space. Furthermore, with opened doors not occupying the front of the cage, occupational safety is increased due to reduced risk of an employee or handling equipment coming into contact with the doors during loading or unloading of the cage. This also greatly improves the reliability of the cage. While enabling easy access into the cage as well as fluent operation, the simple construction of the cage provides similar robustness and manufacturing economy as conventional collection cages.

According to one advantageous embodiment the pivoting means of the cage comprise at least two angle members, which are connected to the door at a distance from each other and which have a first portion protruding from the door and have a second portion in an angled position, preferably perpendicularly, relative to the first portion. The pivoting means also comprise at least two corresponding rails connected to a lateral wall of the cage, wherein the angle members are adapted movably to a rail from the second portions for moving the door in relation to the lateral wall. With the aid of the described embodiment, strength properties of the cage are improved since possible impacts on the door are directed to the frame member rather than to a rather delicate traditional hinge, thus damaging its clearance. Furthermore the first portion acts as a limiter preventing the doors from turning excessively inside the cage, which makes further limiters unnecessary.

BRIEF DESCRIPTION OF THE DRAWINGS

In the following, some embodiments of the invention are described with reference to the accompanying drawings, in which.

DESCRIPTION OF THE PREFERRED EMBODIMENTS

Figure 1:
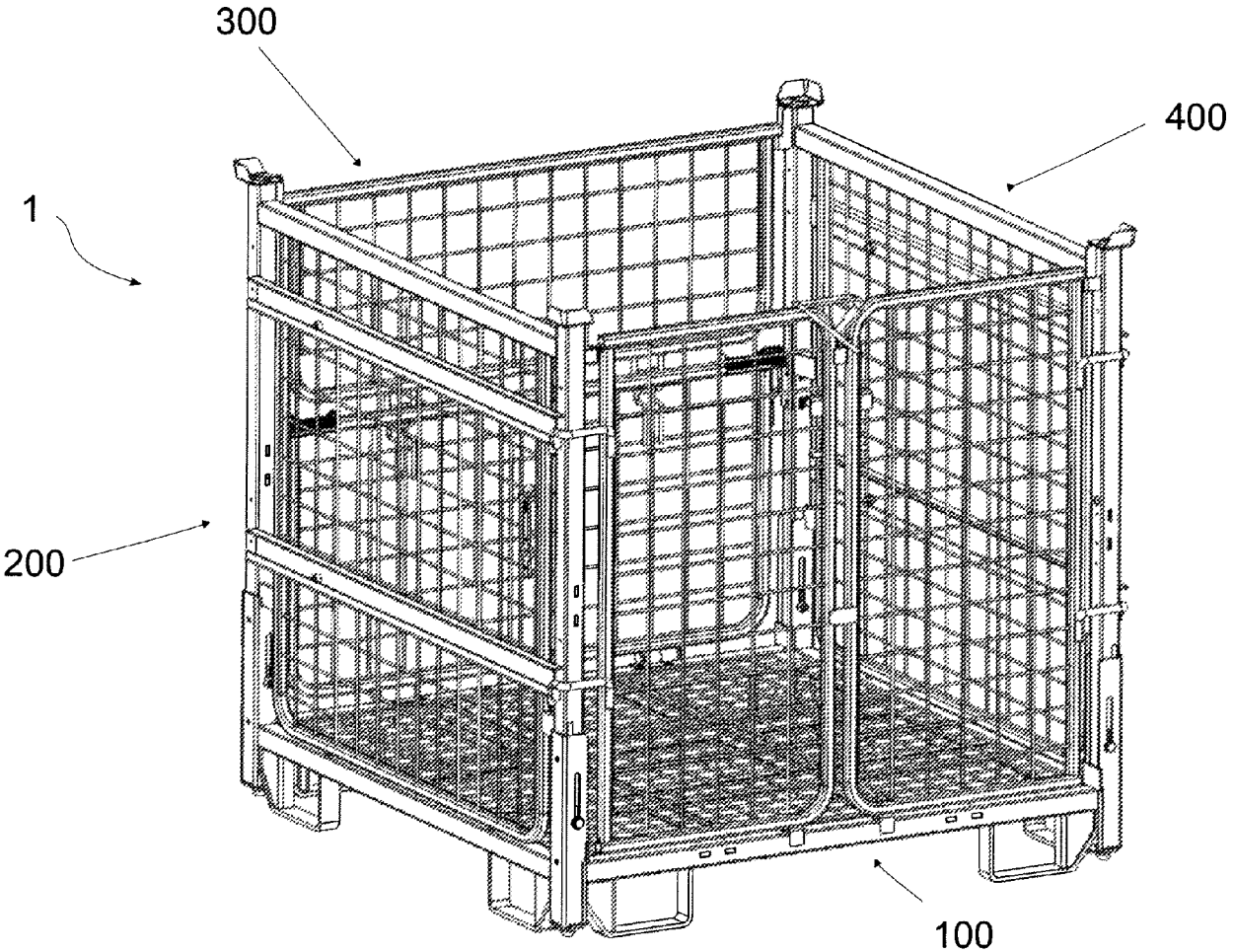
FIG. 1 presents an isometric frontal view of a closed cage according to one embodiment the invention.

As illustrated in FIG. 1 a cage 1 according one to the invention has a prismatic crate-like shape. The dimensions of the cage 1 conform advantageously to an industrial standard, such as EUR- or UK-sizes, for occupying the local transport equipment as efficiently as possible. Indeed, the cage 1 has therefore six faces. According to one embodiment, one of the six faces is used for loading and unloading the cage 1, which face is herein referred to as the front end 100. The cage 1 can have more than one face for loading within the scope of the invention.

Figure 2:
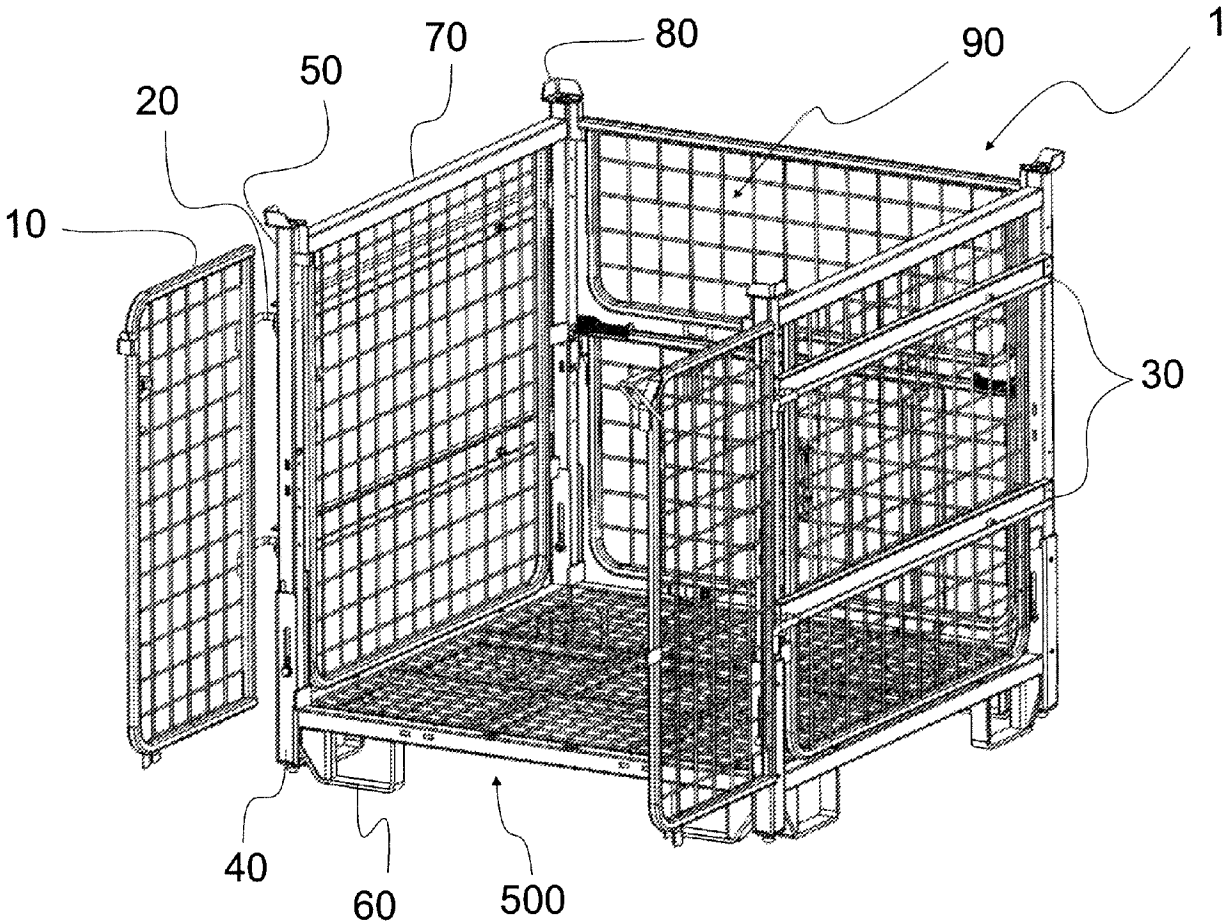
FIG. 2 presents an isometric frontal view of an opened cage of FIG. 1.

As the cage 1 is prismatic, it has two side walls—first lateral wall 200 and second lateral wall 400—on each side of the front end 100 perpendicularly thereto. The lateral walls 200, 400 comprise vertical frame members 50 and horizontal frame members 70, which are connected together to form a rectangular frame, as illustrated in FIG. 2. The frame is equipped with a mesh 90, which is preferably made of high tensile steel for protecting the contents of the cage 1 during handling. There is also a third lateral wall 500, which acts as a bottom to the cage 1 connecting the first and second lateral wall 200, 400. The third lateral wall 500 has a similar structure to first and second lateral walls 200, 400. The cage 1 further has a rear wall 300, which has a similar basic frame and mesh structure as the lateral walls 200, 400 and which is connected to the third lateral wall 500. The rear wall 300 is preferably connected to the third lateral wall 500 with hinges so that the rear wall 300 can be folded down on top of the third lateral wall 500. For locking the rear wall 300 in an upright position, it is equipped with projections which are adapted to engage with corresponding slots in the neighbouring vertical frame members 50.

Figure 10:
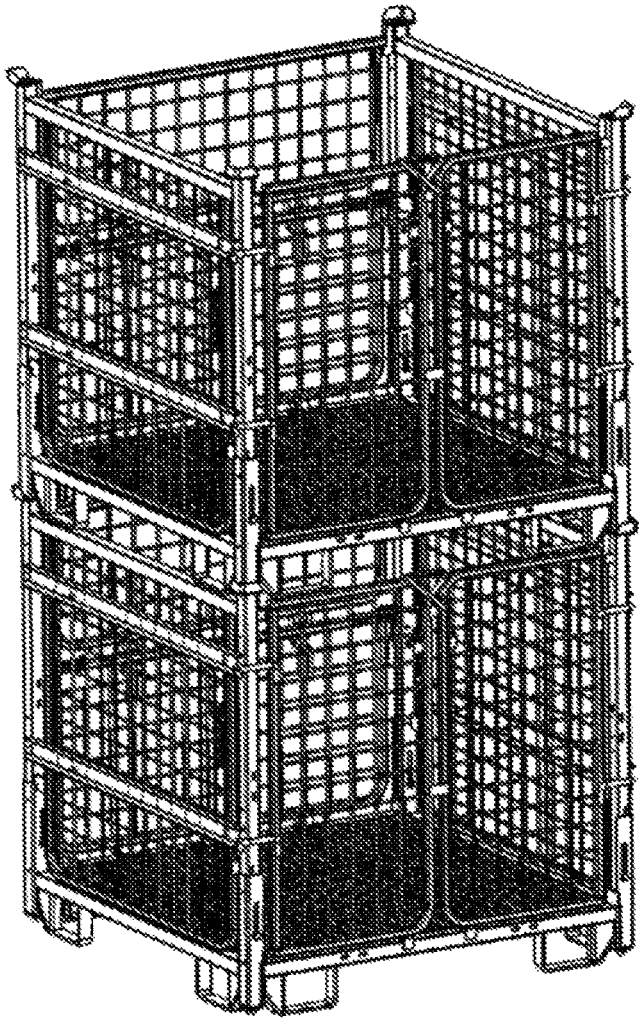
FIG. 10 presents an isometric frontal view of two cages of FIG. 1 stacked on top of each other.

Attached to the corners of the third lateral wall 500, are frame pillars 40, which extend above and below the third lateral wall 500 and form the base of the cage 1. The lower ends of the vertical frame members of the first and second lateral walls 200, 400 are accommodated within the frame pillars 40. Frame pillars 40 and vertical frame members 50 are advantageously provided with a vertical groove and a peg, respectively, so that the lateral walls 200, 400 can be lifted up and folded down for collapsing the cage 1. Furthermore, the upper ends of the vertical frame members of the first and second lateral walls 200, 400 are equipped with receptive seats 80. As illustrated in FIG. 10, the receptive seats 80 are adapted to engage with the lower ends of the frame pillars 40 when cages 1 are stacked on top of each other. Catering for the handling of the cage 1, the third lateral wall 500 is equipped with handling brackets for receiving e.g. the lifting forks of a fork lift.

Figure 9:
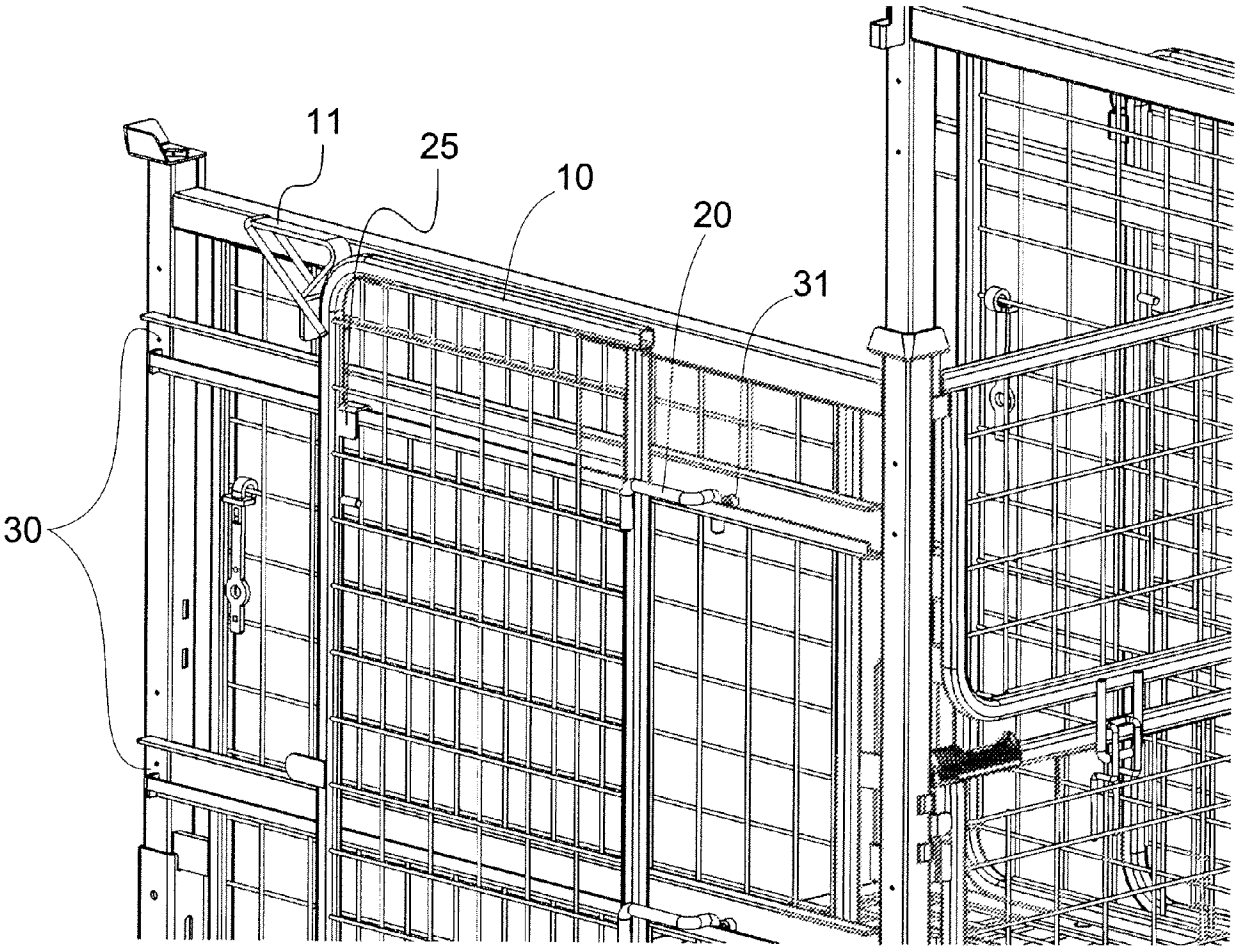
FIG. 9 presents an isometric rear view of the cage of FIG. 3.

According to the embodiment presented in FIG. 2, front end 100 is open and can be closed with doors 10. According to this specific embodiment, the cage 1 has two doors 10, which are hinged to the first lateral wall 200 and second lateral wall 400 so that the door 10 can be pivoted to a closed position, wherein the door 10 is parallel to front end 100 thus covering it at least partly, and to an opened position, wherein the door 10 is non-parallel to front end 100 for enabling access to the cage 1. One of the doors 10 is equipped with a coupling 11, which is adapted to engage with the other door 10 when the doors 10 are closed for coupling them together (FIG. 9). As illustrated in greater detail in FIGS. 4 and 5, the door 10 is hinged to the lateral wall 200, 400 with pivoting means 20, 30. Within the scope of the invention, there can be a smaller or larger amount of doors 10, which can be hinged to different walls, such as the third lateral wall 500, than described herein. According to one advantageous embodiment, however, the pivoting means comprise two angle members 20, which are fixed to the frame of the door 10 at a distance from each other, and two corresponding rails 30, which are fixed to the lateral wall 200, 400 at a similar distance from one another. The free end of angle member 20 is adapted movably to the rail 30 so that the door 10 can be slid along the rail 30 and ultimately along the lateral wall 200, 400. As illustrated in FIG. 9, the rail 30 has a G-shaped cross-section for preventing the angle member 20 from dropping out as well as for providing a sliding surface. The door 10 is preferably equipped with a hook 25, which is adapted to engage with the rail 30 for providing additional support for the door 10.

Figure 3:
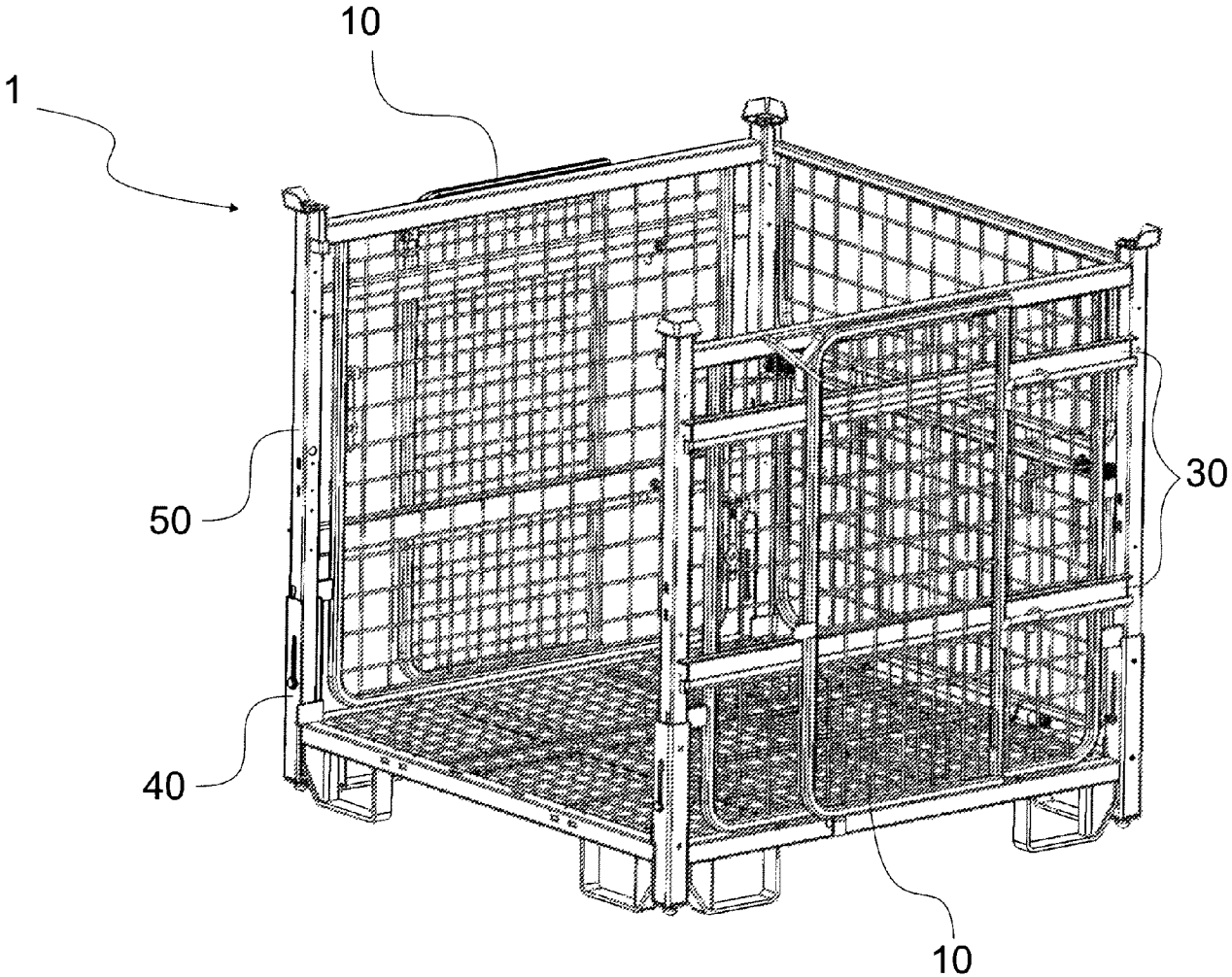
FIG. 3 presents an isometric view of an opened cage of FIG. 1 with flanking doors.
Figure 4:
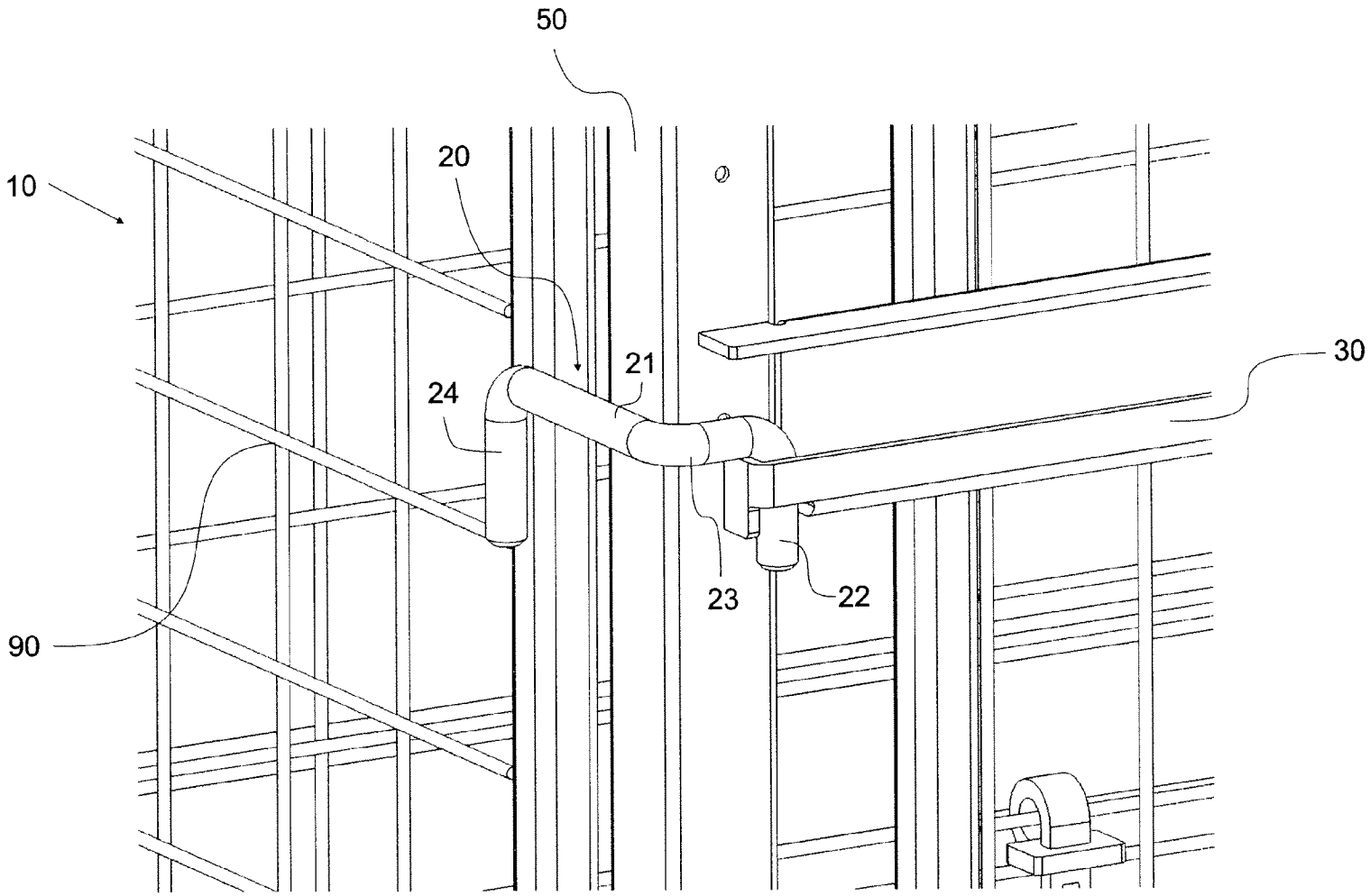
FIG. 4 presents an isometric detailed view of the pivoting means of the cage of FIG. 1.
Figure 5:
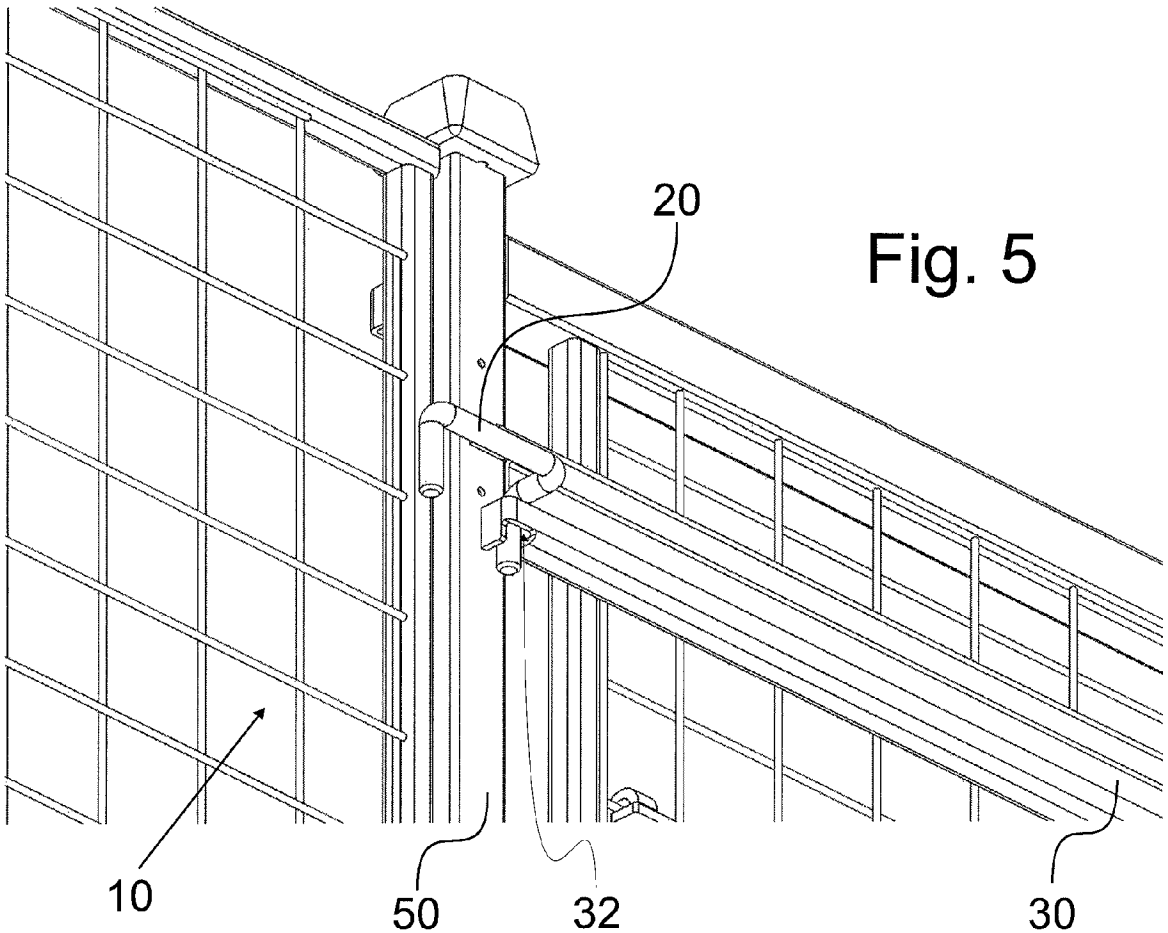
FIG. 5 presents an isometric detailed view of the pivoting means of the cage of FIG. 2.
Figure 6:
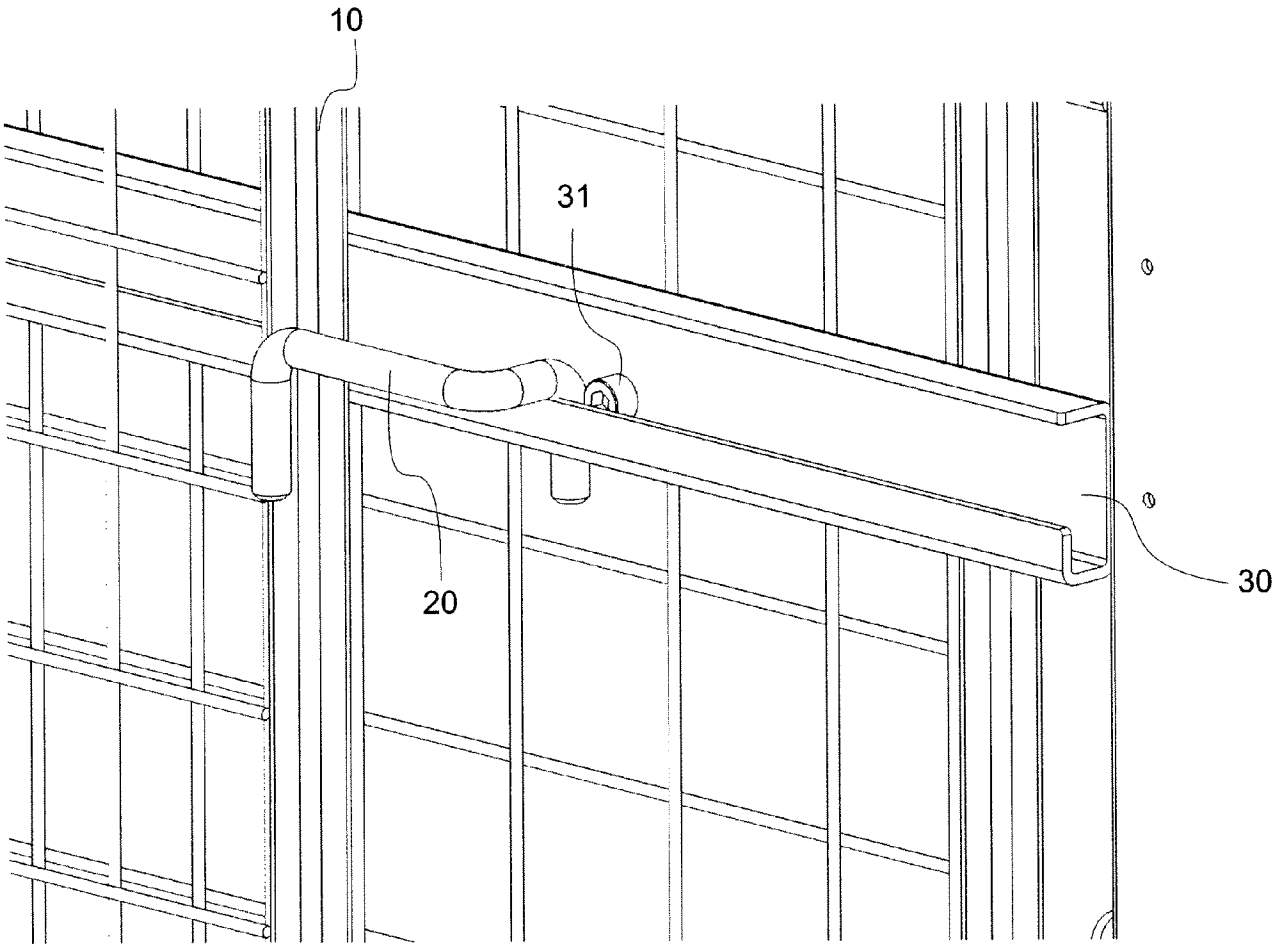
FIG. 6 presents an isometric detailed view of the pivoting means of the cage of FIG. 3.

The angle member 20 is preferably made of a single stainless steel bar, which is bent to a shape having three 90° angles, as illustrated in FIGS. 4 and 5. In essence, the angle member 20 has a first portion 21 that protrudes horizontally from a vertical frame part of the door 10. The first portion 21 may be attached to the door 10 with the aid of an adaptor plate or the angle member 20 can have a vertical fourth portion 24, which is attached to the door and which is connected to the horizontal first portion 21 through a 90° angle (FIGS. 4 and 5). When the door 10 is in a closed position, the first position 21 rests against the vertical frame member 50. This is improves the strength properties of the cage, as possible impacts on the front end 100, more specifically to the door 10, are directed to the frame member rather than to a rather delicate traditional hinge, thus damaging its clearance. In addition, the first portion 21 acts as a limiter preventing the doors 10 from turning excessively inside the cage 1. Consequently, no further limiters are necessary. In the free end of the first portion 21 is a third portion 23, which is angled 90° horizontally so that, when assembled, the third portion 23 points toward the rail 30. The third portion 23 provides offset for the door 10 for establishing clearance when the door 10 is slid along the rail 30. In the other end of the third portion 23 is a second portion 22, which is angled 90° vertically so that, when assembled, the second portion 22 points downward. The free end of the second portion 22 is adapted movably to the rail 30 so that the angle portion 20 and thus the door 10 can be moved along the rail 30. The rail 30 has a hole for receiving the free end of the second portion 22 so that door 10 can be dropped into a locked position wherein the hole acts as a hinge (FIG. 5). A similar hole is provided further back the rail 30 (FIGS. 6 and 9) for locking the door to a flanking position as illustrated in FIG. 3. Generally speaking, the angle portion 20 may alternatively have another shape of form deviating from what has been herein described.

Figure 14:
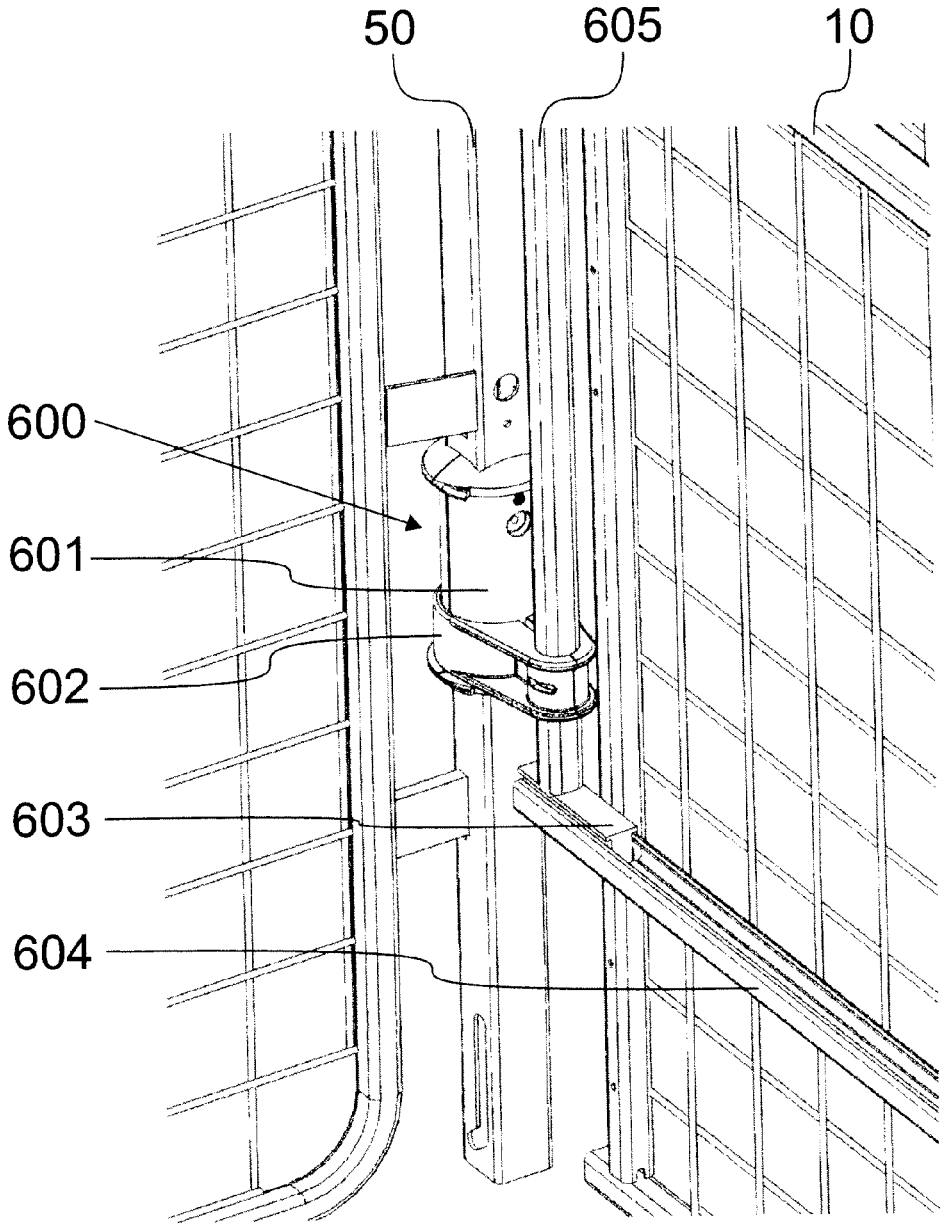
FIG. 14 presents an inside view of the cage of FIG. 13.

Without deviating from the scope of the present invention, the pivoting means may also be provided using alternative constructions. According to another embodiment presented in FIGS. 13-16, the pivoting means comprise two multi-axis hinges 600 being located at a distance from each other. The multi-axis hinges 600 are adapted to pivot the door to an opened and to a flanked position as described above. As seen in detail from FIG. 14, the multi-axis hinge 600 is adapted between the vertical frame member 50 of a lateral wall and the door 10. The FIG. 14 also illustrates that the multi-axis hinge 600 comprises a plurality of parts fitted movably to each other. The multi-axis hinge 600 comprises a sleeve 601, made preferably of durable plastic or plastic compound, which is clamped around the vertical frame member 50 and secured into position with screws or bolts. The sleeve 601 has groove in its lower end. The multi-axis hinge further comprises an arm 602, which is fitted to said groove. The arm 602 is fitted onto the groove pivotally so that the fit acts as a hinge. At the other end of the arm 602 is a hole into which a connecting rod 605 has been fitted. The connecting rod 605 connects the arms 602. The connecting rod 605 is rotatable within the holes of the arms 602, whereby the fit there between acts as a second hinge of the multi-axis hinge 600. To the lower end of the connecting rod 605 has been fitted a guide 603 equipped with rollers for reducing rolling resistance. The guide 603 is adapted to be propelled with the aid of its rollers along a rail 604, which is attached to the door 10. More specifically, the rail 604 is attached on the inside of the door 10. Since the multi-axis hinge 600 comprises two sleeves 601 and two arms 602, which are connected by the connecting rod 605, the multi-axis hinge 600 naturally comprises two rails 604. Therefore the connecting rod 605 has two guides, one in each end thereof.

According to the present invention, the embodiment (FIGS. 13-16) described above may also have other manifestations. For example, the pivoting means could comprise more than two multi-axis hinges 600 and, thus, more than two rails 604. The pivoting means could alternatively consist of only one multi-axis hinge 600. Furthermore, the "first hinge", i.e. the sleeve 601 and arm 602 of the multi-axis hinge 600, could also be constructed with a single part being adapted rotatably around the vertical frame member 50.

Figure 15:
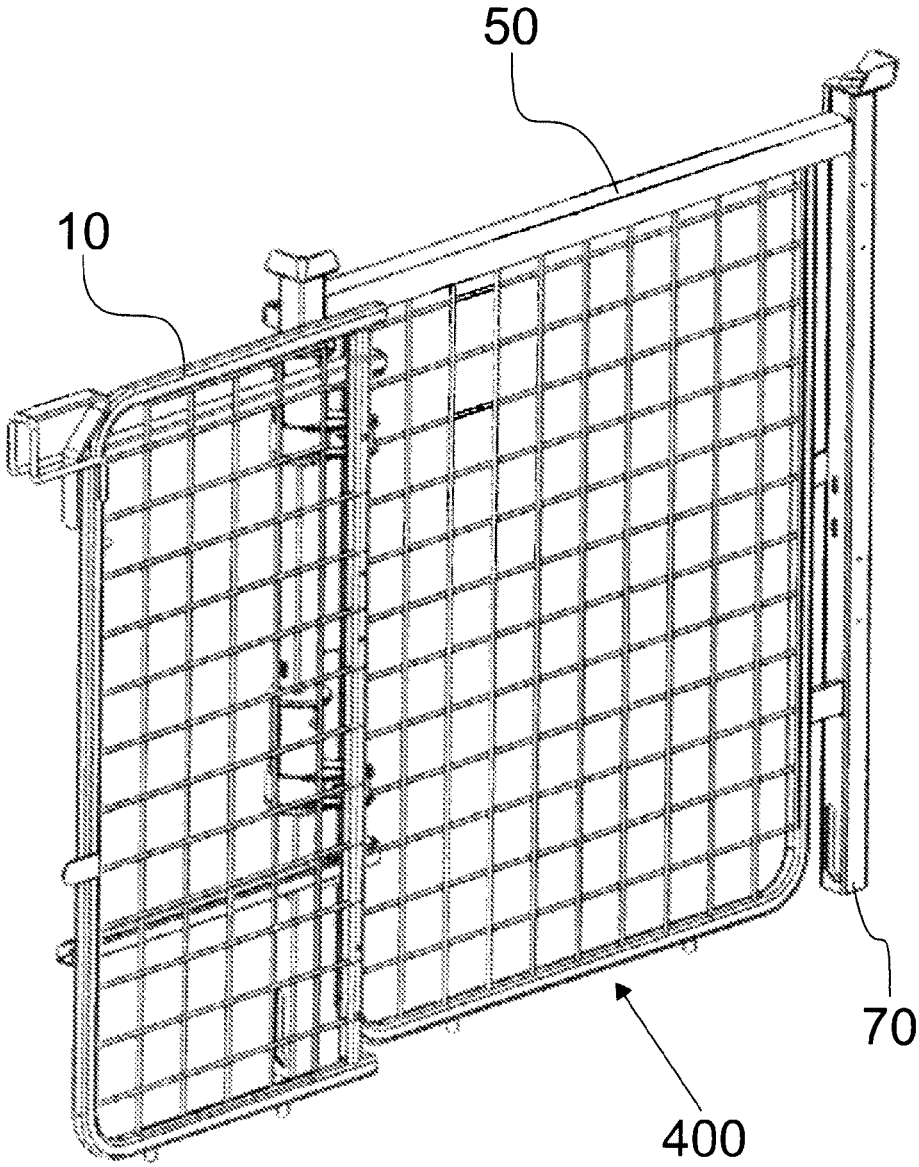
FIG. 15 presents an isometric frontal view of the cage of FIG. 13 in an opened position.
Figure 16:
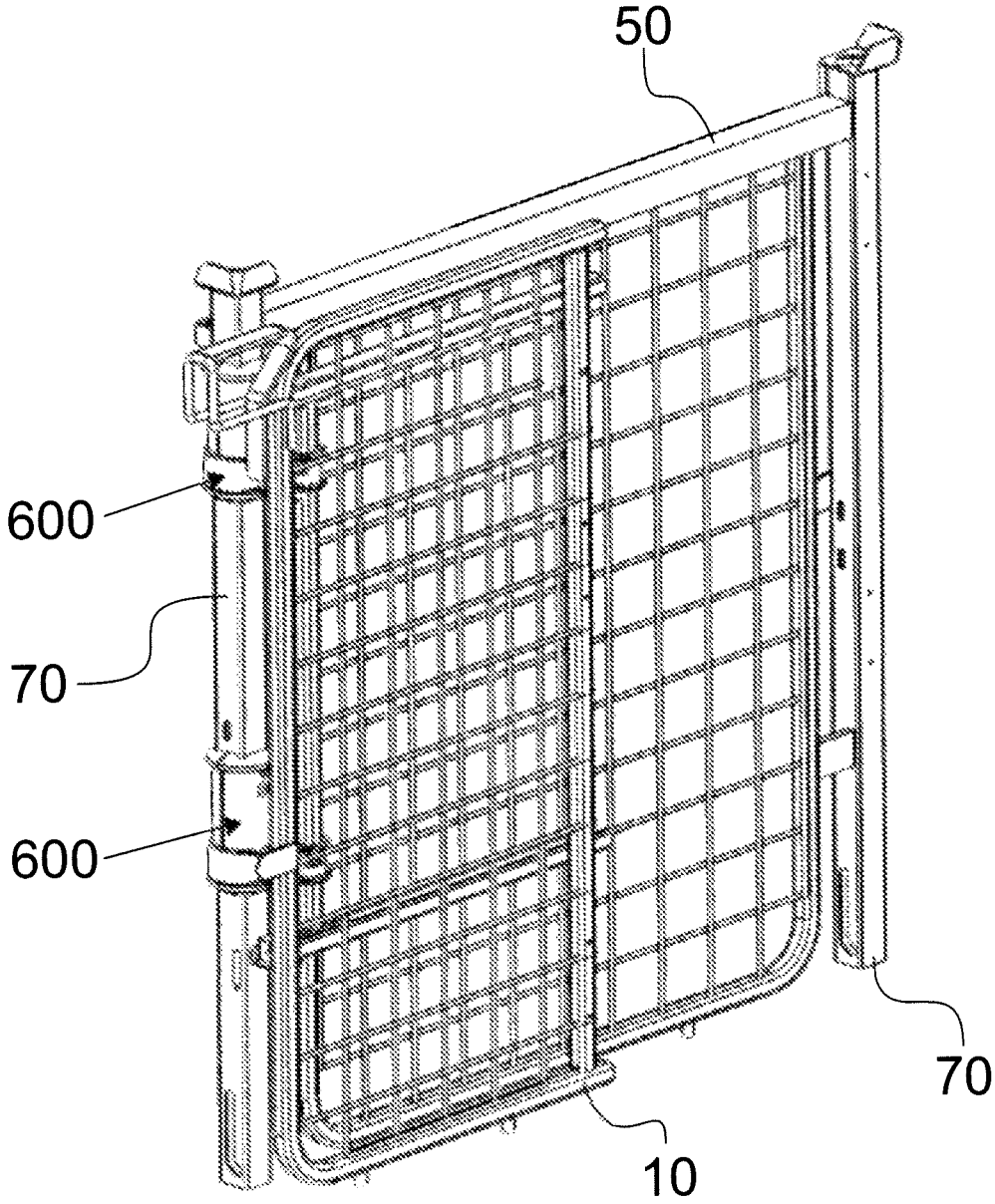
FIG. 16 presents an isometric frontal view of the cage of FIG. 15 in a flanked position.

The doors 10 of a cage 1 according to the embodiment illustrated in FIGS. 13-16 can be pivoted to a flanked position by exploiting the sliding fit between the guide 603 and rail 604 as well as the rotational fits between the sleeve 601 and arm 602 and further between the arm 602 and connecting rod 605. The door 10 is therefore pivoted to an opened position by rotating the arm 602 in relation to the sleeve 601 and, thus, to the vertical frame member 50 of the cage 1. During the rotation, the connection 605 also rotates in relation to the arm 602. Since neither rotation is restricted to e.g. 90°, the door 10 can be opened so that it is parallel to the lateral wall 400 (FIG. 15). When opened, the door 10 can be pushed rearward by sliding the guides 603 within the rails 604 with the rollers acting as bearings, whereby the door 10 can be easily moved to a flanked position (FIG. 16).

Within the scope of the invention, the cage 1 may also have other embodiments deviating from what has been described herein. For example, rather than having two doors 1, the cage 1 could also be equipped with one door 1, which would be adapted to flank an entire lateral wall. Furthermore, the doors 1 or door 1 could be adapted to flank the bottom of the cage 1, i.e. the third lateral wall 500, wherein rails 30 would be adapted thereto and the angle member 20 accordingly.

According to another embodiment, the cage 1 is equipped with a fifth lateral wall acting as the ceiling. The ceiling could be equipped with pivoting means 20, 30 so that the doors 1 or door 1 would be adapted to flank the top of the cage 1. However, this would require that the handling brackets 60 are arranged so that they do not obstruct the movement of the doors 1 or door 1.

According to yet another embodiment, the rails 30 are fitted within the cage 1, i.e. on the inside of the lateral walls, whereby the doors 1 are adapted to flank the cage 1 inside thereof. This would be beneficial in situations, in which cages 1 are arranged very close to one another. On the other hand, the embodiment would reduce the inner volume of the cage 1.

As said, the present invention has a great plurality of alternative embodiments. Consequently, the scope of the invention is not defined merely by the embodiments described herein, but rather by the accompanied claims.

Referring back to the embodiment illustrated in FIGS. 1-12, the cage 1 is especially easy to load, unload and handle with e.g. a fork lift. The cage 1 can be transported to a loading or unloading position by placing lifting forks of a fork lift into the handling brackets 60 under the third lateral wall 500. The cage 1 is opened by first lifting the door 10 with the coupling 11, whereby the door 10 is released from the other door 10 and can be turned into an opened position (FIG. 2). Once the door 10 is lifted, the second portion 22 of angle member 20 is removed from the corresponding hole in rail 30, whereby the door 10 is slid along the rail 30, until stopper 31 is reached. The door 10 is then dropped into the receptive hole in rail 30 thus locking the door 10 into a flanking position parallel to the lateral wall 400. A similar action is performed to the other door 10, after which the front end 100 of the cage 1 is completely exposed for loading or unloading. Closing the doors 10 is naturally performed in reverse order.

Figure 7:
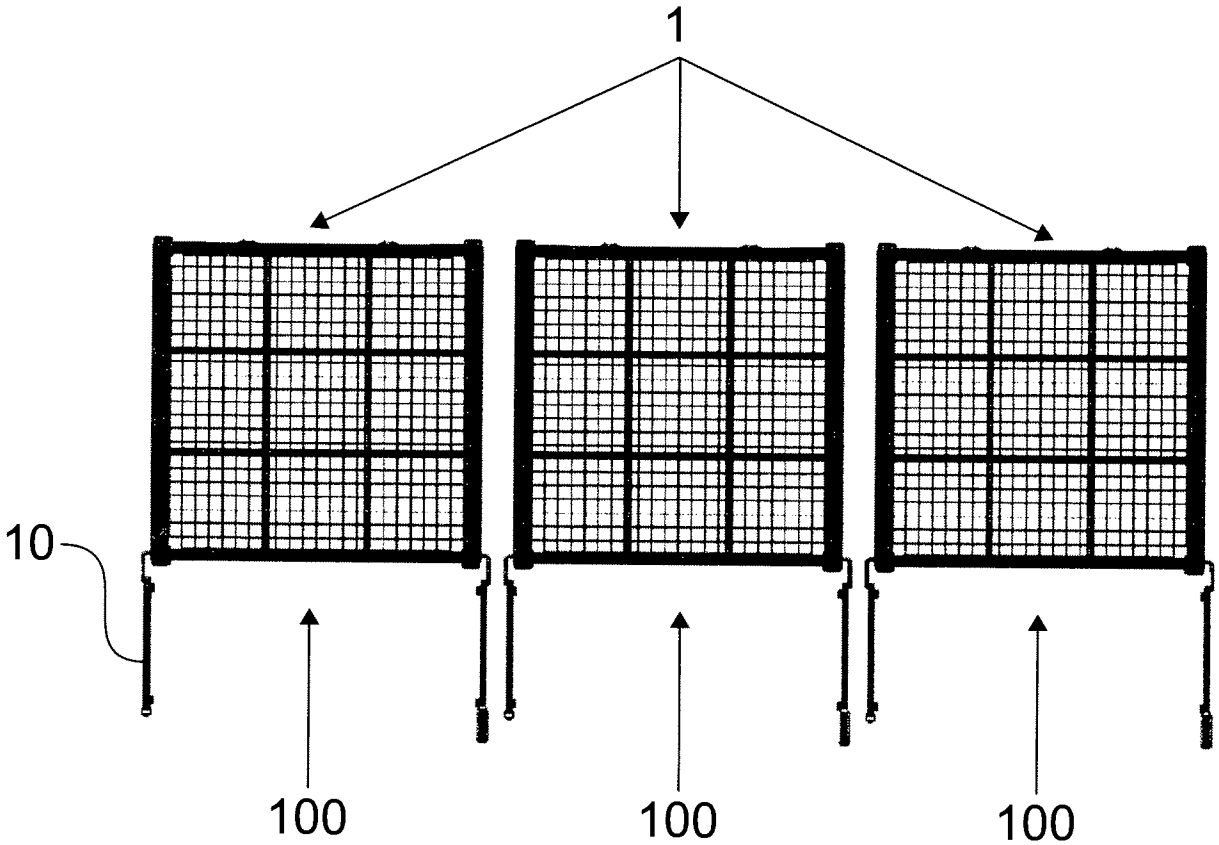
FIG. 7 presents a top projection view of three adjacent cages of FIG. 2.
Figure 8:
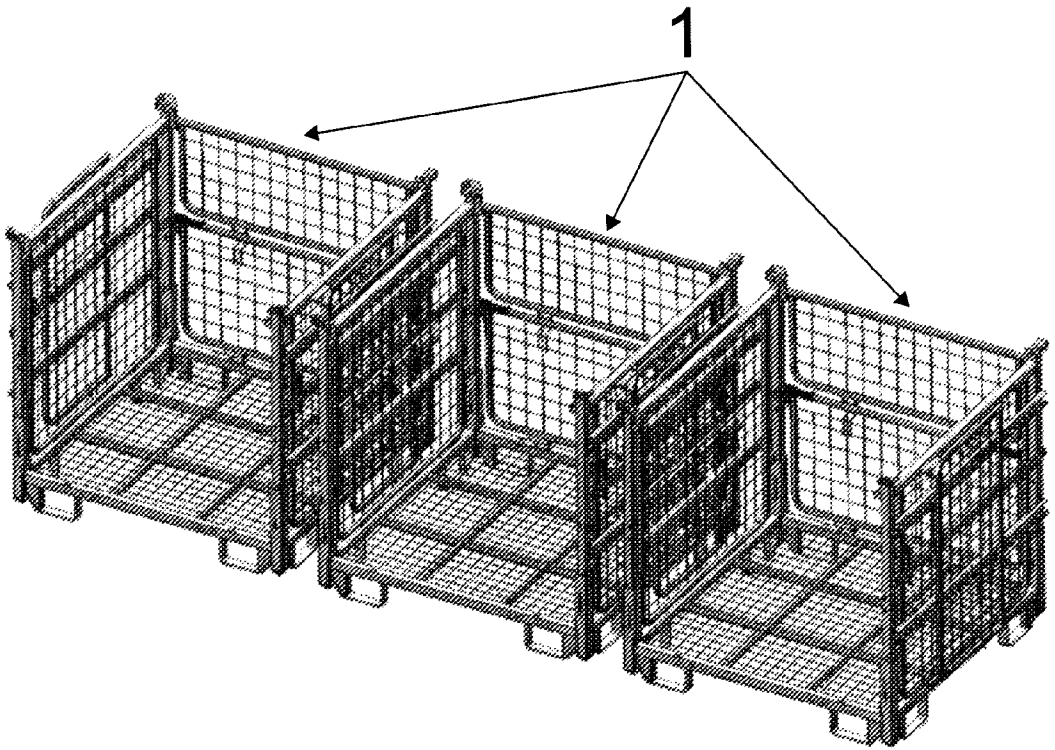
FIG. 8 presents an isometric frontal view of three adjacent cages of FIG. 3.

Being able to flank the doors 10 is especially advantageous in situations, where there is a plurality of cages 1 arranged next to each other as illustrated in FIG. 7. Without the ability to slide the doors 10 parallel to the lateral walls 200; 400, the opened doors 10 would make working around the cages 1 more difficult, because they would prevent transversal movement in front of the cages 1. It could also lead to possible occupational safety issues due to e.g. leg and foot injuries. The problem could be solved by having removable doors, but that would result in redundant doors lying around causing more risks and taking up space. The problem could also be solved by having doors 10 adapted to open 180°, in such a case the doors 10 would have to flanked prior to arranging the cages 1 (FIG. 7), wherein the contents of the cage 1 would not be secured during the arrangement. As illustrated in FIG. 8, the problem is solved—according to one embodiment—by flanking the doors 10 outside the lateral walls 200; 400, which is especially favourable, if there are cages 1 stacked on top of each other (not shown).

Figure 11:
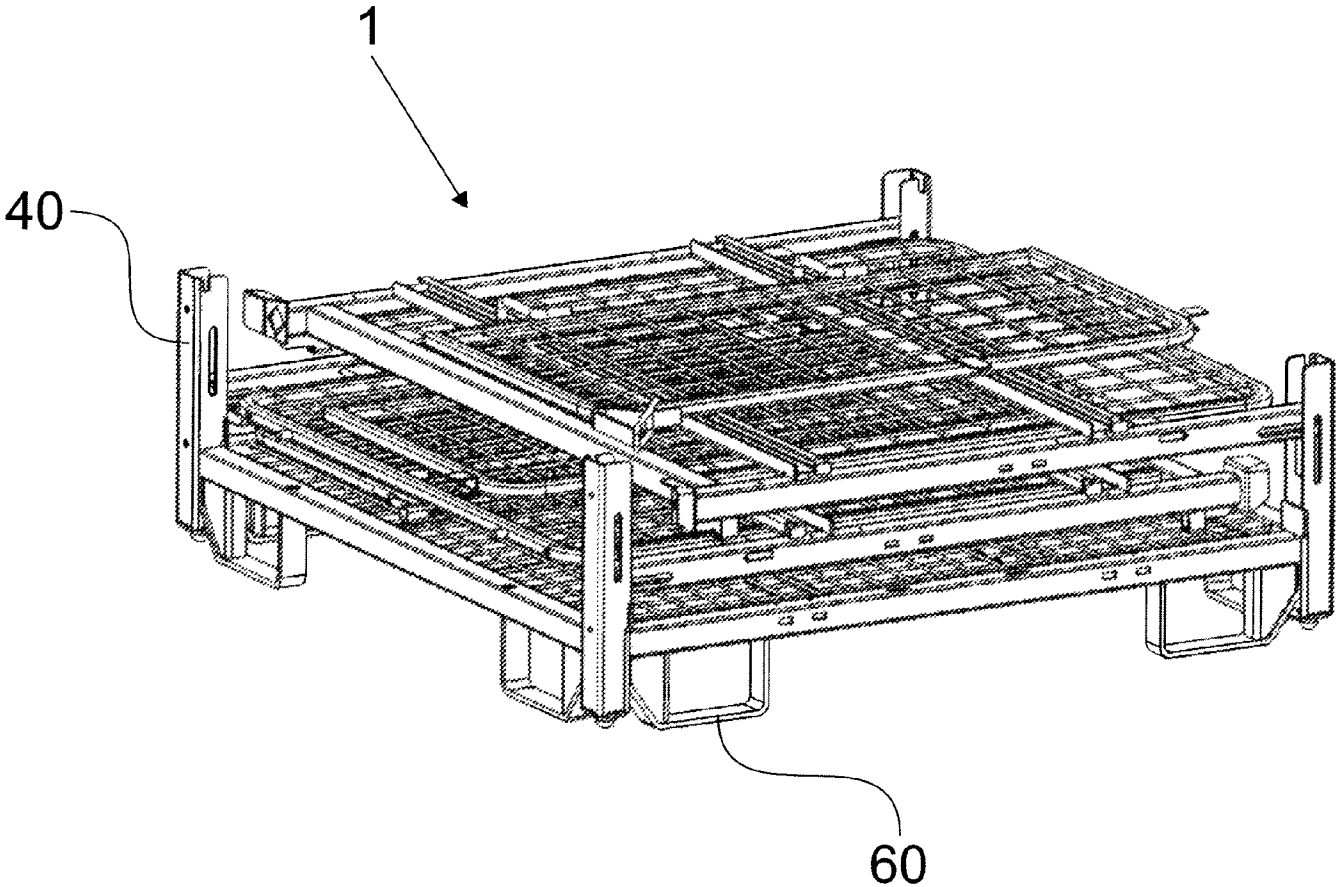
FIG. 11 presents an isometric view of a collapsed cage of FIG. 1.
Figure 12:
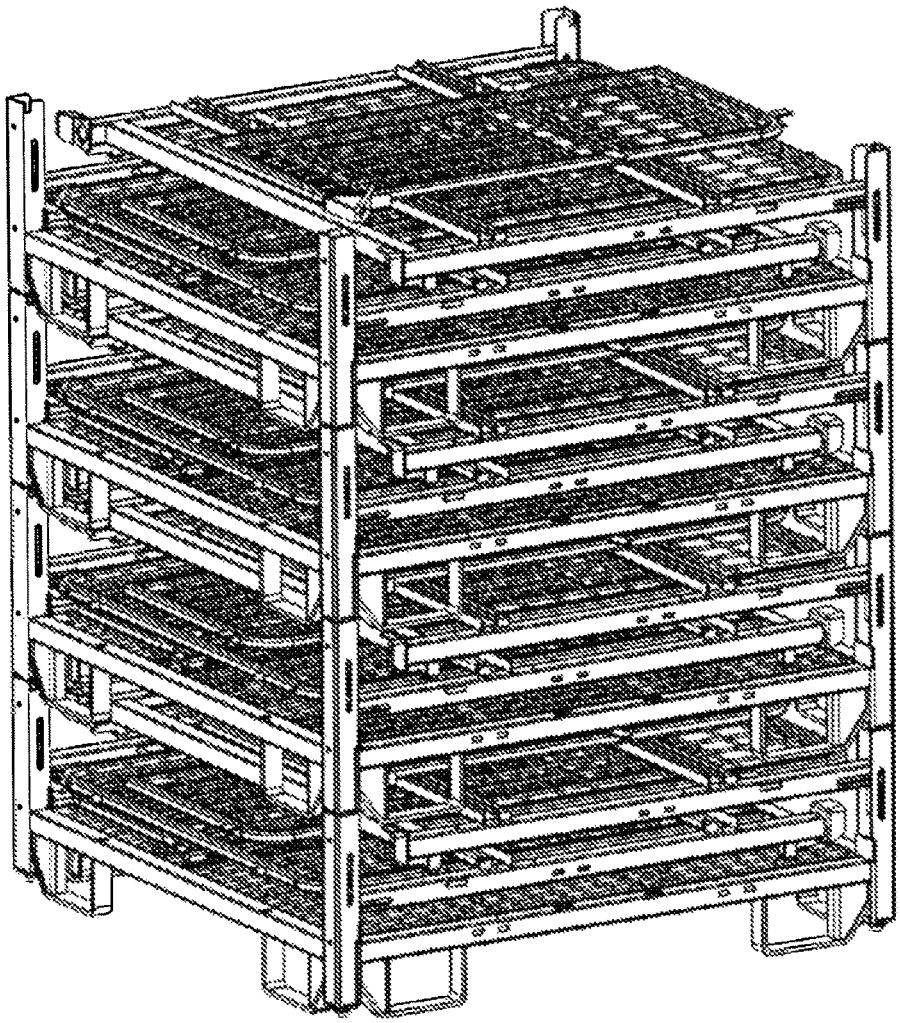
FIG. 12 presents an isometric frontal view of four collapsed cages of FIG. 11 stacked on top of each other.
Figure 13:
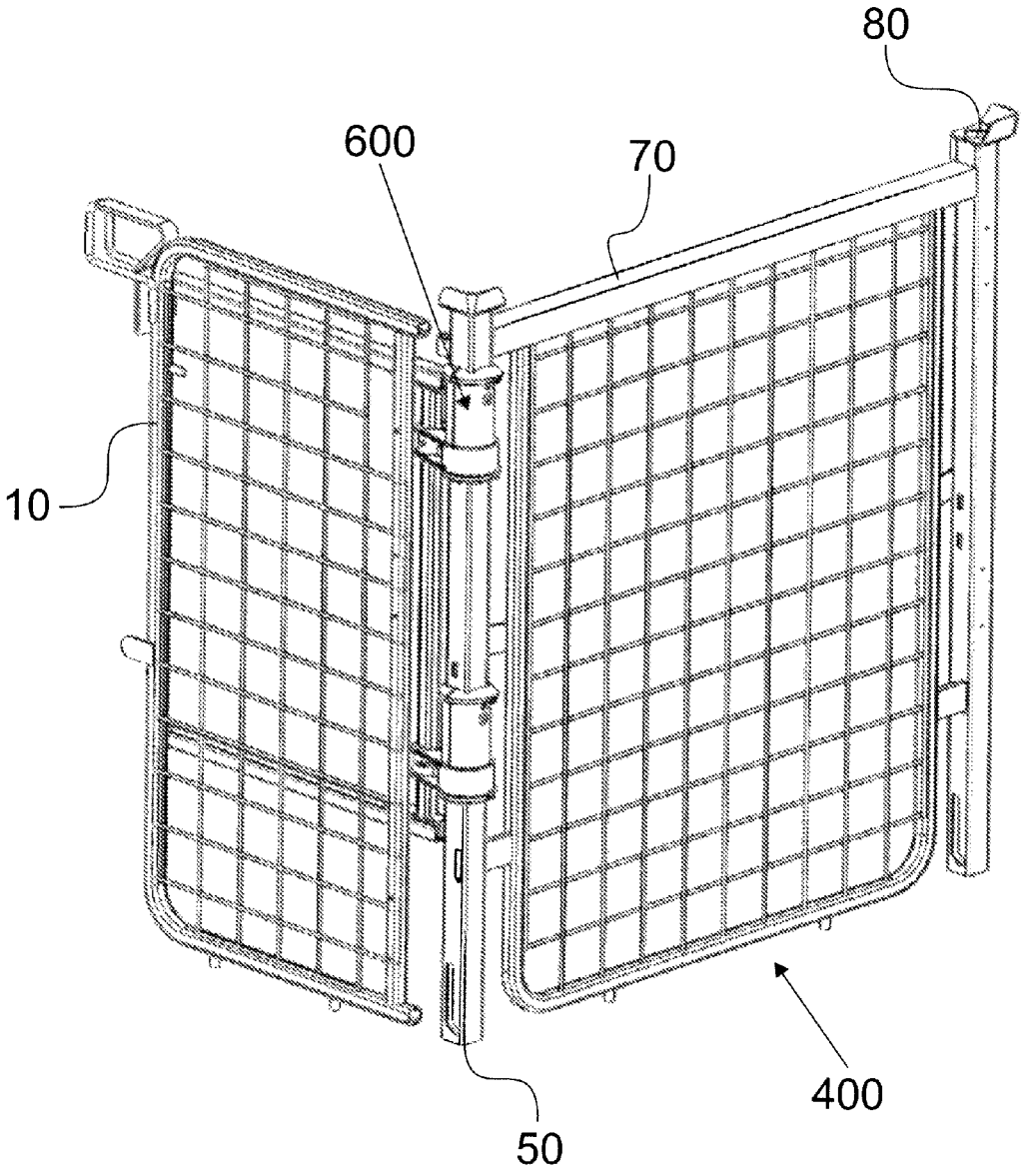
FIG. 13 presents an isometric frontal view of a closed cage according to an alternative embodiment.

When the doors 10 are in a flanked position, an empty cage 1 can be collapsed by folding down the lateral walls 200, 400 as well as the rear wall 300, as illustrated in FIG. 11. The rear wall 300 is folded down simply by rotating it in relation to the hinges connected between the third lateral wall 500 and the lower horizontal frame member of the rear wall 300. The lateral walls 200, 400 are folded by first lifting them upward, whereupon the lower ends of the vertical frame members 50 rise from the frame pillars 40, after which they are be folded down on top of the rear wall 300 and each other. When the empty cage 1 is collapsed, a plurality of collapsed cages 1 can be stacked on top of each other, wherein they take up only little space (FIG. 12). Thanks to the interconnectability of seats 80 and the lower end of frame pillars 40, the stack of cages 1 is considerably solid and can be trans-ported easily with a fork lift.

According to one embodiment the pivoting means 600 comprises at least one arm 602, from one end of which adapted pivotably to a frame member of a lateral wall 200, 400, and at least one rail 604 connected to the door 10, preferably on the inside thereof. The means 600 also comprise at least one connecting rod 605 being adapted pivotably to the second end of the arm 602 and being fitted slidably to the rail 604 from one end. The pivoting means 600 further comprise a sleeve 601 which is fixed to a frame member of a lateral wall 200, 400, around which sleeve 601 the arm 602 is fitted pivotably. The pivoting means 600 further comprise a guide 603 which is attached to said end of the connecting rod 605 and which is adapted to be slid along the rail 604. The pivoting means 600 preferably comprise at least two sleeves 601 which are adapted to corresponding at least two arms 602 being connected with a connecting rod 605 having corresponding at least two guides 603, which are adapted slidably in corresponding at least two rails 604. The guide 603 is equipped with rollers for reducing rolling resistance.

TABLE 1

List of reference numbers.

| No | Part |
|---|---|
| 1 | cage |
| 10 | door |
| 11 | coupling |
| 20 | angle member |
| 21 | first portion of the angle member 20 |
| 22 | second portion of the angle member 20 |
| 23 | third portion of the angle member 20 |
| 24 | fourth portion of the angle member 20 |
| 25 | hook |
| 30 | rail |
| 31 | stopper |
| 40 | frame pillar |
| 50 | vertical frame member |
| 60 | handling bracket |
| 70 | horizontal frame member |
| 80 | seat |
| 90 | mesh |
| 100 | front end |
| 200 | first lateral wall |
| 300 | rear wall |
| 400 | second lateral wall |
| 500 | third lateral wall |
| 600 | multi-axis hinge |
| 601 | sleeve |
| 602 | arm |
| 603 | guide |
| 604 | rail |
| 605 | connecting rod |

The invention claimed is:

1. A cage having a prismatic crate shape for handling or storing goods, particularly parcelled goods, the cage comprising:

a front end, at least one door, pivoting means connected to the at least one door and adapted to allow pivoting of the door to an opened position non-parallel to the front end and to a closed position parallel to the front end covering at least part of said front end at least three lateral walls perpendicular to said front end, wherein the pivoting means guides the at least one door in an opened position parallel to a lateral wall outside and at a clearance therefrom for flanking the cage, and wherein the pivoting means comprise:

at least two angle members connected to the door at a distance from each other and having a first portion protruding from the door and having a second portion in a fixed angled position substantially perpendicular to the first portion, and at least two corresponding rails connected to an outside face of a lateral wall, wherein the angle members move on the rails via the second portions for moving the door in relation to the lateral wall.

2. A cage according to claim 1, wherein the angle member has a third portion between the first and the second portion perpendicularly to both portions for providing clearance for the door upon opening it.

3. A cage according to claim 1, wherein the rails have holes for receiving the second portion of the angle member, whereby the door is securable to the rail.

4. A cage according to claim 1, wherein the rail is equipped with a stopper, such as the head of a screw, for positioning the door to secured position and for restricting its movement.

5. A cage according to claim 1, wherein the cage further comprises a foldable rear wall, and in that at least two lateral walls are foldable, whereby the cage is collapsible.

* * * * *

UNITED STATES PATENT AND TRADEMARK OFFICE

CERTIFICATE OF CORRECTION

PATENT NO. : 8,550,277 B2
APPLICATION NO. : 13/391043
DATED : October 8, 2013
INVENTOR(S) : Jack Grönholm It is certified that error appears in the above-identified patent and that said Letters Patent is hereby corrected as shown below:

ON THE TITLE PAGE:

At item (73), correct the Assignee to read as follows:

--K. Hartwall Oy Ab, Soderkulla (FI)--.

Signed and Sealed this
Eighteenth Day of February, 2014

Michelle K. Lee

Michelle K. Lee
*Deputy Director of the United States Patent and Trademark Office*